United States Patent [19]

Nemoto et al.

[11] Patent Number: 4,516,101

[45] Date of Patent: May 7, 1985

[54] AIR-FLOW-RATE SENSORS

[75] Inventors: Michio Nemoto; Kiyokazu Yoshida; Tetsuro Baba, all of Sendai, Japan

[73] Assignee: Tohoku Metal Industries, Ltd., Miyagi, Japan

[21] Appl. No.: 582,530

[22] Filed: Feb. 22, 1984

[30] Foreign Application Priority Data

May 2, 1983 [JP] Japan ..... 58-66760[U]
May 14, 1983 [JP] Japan ..... 58-83485
May 14, 1983 [JP] Japan ..... 58-71138[U]

[51] Int. Cl.[3] ..... H01H 37/58
[52] U.S. Cl. ..... 335/208; 335/217
[58] Field of Search ..... 335/146, 205, 208, 217

[56] References Cited

U.S. PATENT DOCUMENTS

| | | | |
|---|---|---|---|
| 3,008,019 | 11/1961 | Scheidig | 335/208 |
| 3,750,064 | 7/1973 | Kato et al. | 335/208 |
| 3,903,492 | 9/1975 | Endo et al. | 335/208 |
| 4,023,128 | 5/1977 | Itou et al. | 335/217 X |
| 4,414,519 | 11/1983 | Anderson et al. | 335/208 |
| 4,414,520 | 11/1983 | Ruuth | 335/208 |

FOREIGN PATENT DOCUMENTS

| | | | |
|---|---|---|---|
| 1549349 | 12/1968 | France | 335/208 |

*Primary Examiner*—George Harris
*Attorney, Agent, or Firm*—Frishauf, Holtz, Goodman & Woodward

[57] ABSTRACT

A air-flow-rate sensor having a thermo-magnetically operated switch including a U-shaped temperature sensitive ferromagnetic piece, a positive temperature characteristic thermister, and two terminal plates, which are stationarily mounted in an opening chamber of an insulator frame. The two terminal plates are for connecting the thermister to an external electric power source and are in contact with respective input electrodes on opposite surfaces of the thermister. One of the two terminal plates is formed in a generally arcuate form to elastically press the other terminal plate onto the ferromagnetic piece through the thermister. The thermo-magnetically operated switch is fixedly mounted on the frame by fitting its opposite terminals into grooves formed in the inner wall of the frame. Each terminal plate is also fixed to the frame by fitting both ends into another grooves formed in the inner wall of the frame. The thermister is fixedly supported between the two terminal plate by engaging projections formed on one terminal plate. The frame may have grilles for covering the opening chamber.

18 Claims, 8 Drawing Figures

AIR-FLOW-RATE SENSORS

BACKGROUND OF THE INVENTION

This invention relates to air-flow-rate sensors for detecting air-flow rate more or less than a predetermined level which are used, for example, for detecting ventilation failure, and in particular, to those air-flow-rate sensors including a thermo-magnetically operated switch and a heater disposed adjacent the switch.

Air-flow-rate sensors have been used in various fields where it is required to detect whether the current air-flow rate is more than a predetermined level or not. For example, the sensors have been used for detecting the ventilation failure in electronic or electric equipments or a forced air-cooling type, and controlling alarm devices or power feed to those equipments so as to protect those equipments from undesirable overheating due to the ventilation failure.

A known air-flow-rate sensor, which is particularly adaptable for detecting the ventilation failure, includes a thermo-magnetically operated switch and an electric heater disposed adjacent the switch. The thermo-magnetically operated switch is formed by an assembly of a reed switch, one or more temperature sensitive ferromagnetic bodies and one or more permanent magnets, as disclosed in French Pat. No. 1,549,349, U.S. Pat. No. 3,750,064 and others. The heater uses a heating wire such as a nichrome wire or a metal oxide blazed resistor as a heating element.

In use, the sensor having the thermo-magnetically operated switch is disposed in an air flow to be monitored, for example, mounted to a ventilation fan, and the heater is energized. During a period when the air flow is maintained above a predetermined rate, the heater and the thermo-magnetically operated switch are air-cooled and therefore, the temperature sensitive ferromagnetic body is not heated to its Curie point so that the thermo-magnetically operated switch does not operate. When air flow stops, or when air-flow rate considerably reduces, due to a certain trouble, for example, breakdown of the ventilation fan, the temperature sensitive ferromagnetic body is heated above its Curie point so that the thermo-magnetically operated switch operates, that is the ventilation failure is detected.

Although the known air-flow-rate sensor using the thermo-magnetically operated switch is excellent in the life time and reliability, it has several problems for safety. During the ventilation failure period, the heater temperature elevates abnormally to cause a fire. Since the sensor is covered with duct in long use, a fire becomes apt to be caused by overheating. Furthermore, dust accumulating in a gap between the heater and the thermo-magnetically operated switch interferes heat transfer from the heater to the thermo-magnetically operated switch, so that the responsibility of the sensor is degraded. This also results to overheating of the electric equipment of a forced air-cooling type.

SUMMARY OF THE INVENTION

It is an object of this invention to provide an air-flow-rate sensor which is excellent in reliability and safety.

It is another object of this invention to provide an air-flow-rate sensor whose responsibility to air-flow-rate variation is not degraded by dust collecting onto the sensor in long use.

It is still another object of this invention to provide an air-flow-rate sensor which is compact and is simple in construction and assembling.

According to this invention, an air-flow-rate sensor for detecting whether the current air flow is less than a predetermined rate or not is obtained which comprises an insulator frame having an opening chamber, a thermo-magnetically operated switch fixedly disposed within the opening chamber of the frame means, and positive temperature characteristic thermister means. The thermo-magnetically operated switch comprises an assembly of a reed switch unit, at least one permanent magnet and at least one temperature sensitive ferromagnetic piece mounted on the reed switch unit. First terminal plate means is fixedly mounted on the insulator frame to extend within the opening chamber and is in contact with the temperature sensitive ferromagnetic piece of the thermo-magnetically operated switch. Second terminal plate means is fixedly mounted on the insulator frame to extend within the opening chamber and is disposed spaced from the first terminal plate means. The positive temperature characteristic thermister means has two electrodes on its opposite side surfaces and is fixedly held by the first and second terminal plate means so that the two electrodes are in close contact with the first and second terminal plate means, respectively.

According to an aspect of this invention, the second terminal plate means is bent into a form of an arch so that the central portion thereof is nearer to the first terminal plate means than the remaining portion thereof, and the positive temperature characteristic thermister means is therefore pressed onto the first terminal plate means due to elasticity of the second terminal plate means bent.

The second terminal plate means is provided with several tab means which project from peripheries of its central portion and the tab means engage with side surfaces of the positive temperature characteristic thermister means to prevent the thermister means from moving on the second terminal plate means.

Both leads of the reed switch unit, both ends of first terminal plate means and both ends of the second terminal plate means are supported in respective grooves in opposite frame elements of the frame means. The temperature sensitive ferromagnetic piece of the thermo-magnetically operated switch is also fitted partially into grooves of the frame means.

Third and fourth terminal plate means are connected to the leads, respectively, and project outwardly from the frame means. The first and second terminal plate means also project in opposite directions from the frame means.

Third and fourth terminal plate means may be spot-welded to the respective leads of the reed switch at outside of the frame means.

According to another aspect of this invention, the frame means is provided with protecting bars to extend within at least one opening end of the opening chamber.

According to another aspect to this invention, the frame means comprises a main frame portion including the grooves, and a supplemental frame portion is joined to the main frame portion to close the grooves.

Further objects, features and other aspects of this invention will be understood from the following detailed description of preferred embodiments of this invention referring to the accompanying drawings.

DETAILED DESCRIPTION OF PREFERRED EMBODIMENTS

Figure 1:
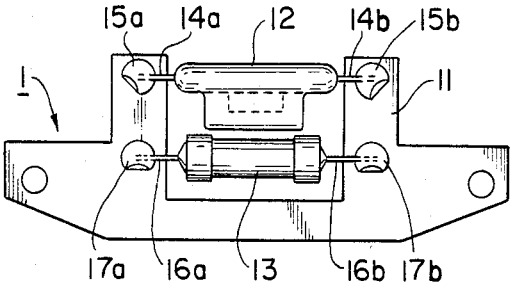
Fig.1 PRIOR ART
FIG. 1 is a front view of a known air-flow-rate sensor.

Prior to description of embodiments of this invention, a known air-flow-rate sensor is described referring to FIG. 1. The air-flow-rate sensor 1 shown therein includes a generally "U"-shaped frame 11 of an insulator plate such as a paper-epoxy sheet laminated, a thermo-magnetically operated switch 12, for example, as shown in FIG. 3*a* of U.S. Pat. No. 3,750,064, and a heater 13 of such as a metal oxide blazed resistor. Opposite leads 14*a* and 14*b* of thermo-magnetically operated switch 12 are soldered to terminals 15*a* and 15*b* on two vertical arm portions of the "U"-shaped frame 11, respectively, so that the thermo-magnetically operated switch 12 is fixedly mounted on frame 11 and disposed within a hollow portion of the "U"-shaped frame 11. Two leads 16*a* and 16*b* of heater 13 are similarly connected to terminals 17*a* and 17*b* on two vertical arm portions of the "U"-shaped frame 11 so that heater 13 is fixedly disposed adjacent, but slightly spaced from, thermo-magnetically operated switch 12. The air-flow-rate sensor like this has been manufactured and sold by Tohoku Metal Industries, Ltd. and available commercially.

In use of the sensor 1, terminals 15*a* and 15*b* are connected to, for example, an alarm device while terminals 17*a* and 17*b* being connected to a power supply, and the sensor 1 is mounted on an electric ventilation fan in an electric equipment of a forced air-cooling type. In this arrangement, the alarm is driven as described above when the ventilation fan is broken down by a certain trouble. Therefore, the electric equipment is protected from being overheated. However, the air-flow-rate sensor 1 has disadvantages as described above.

Figure 2:
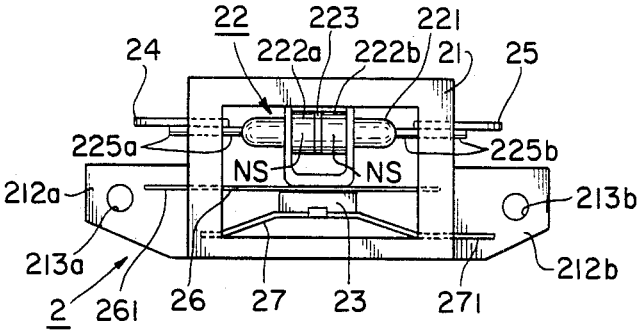
FIG. 2 is a front view of an embodiment according to this invention.
Figure 3:
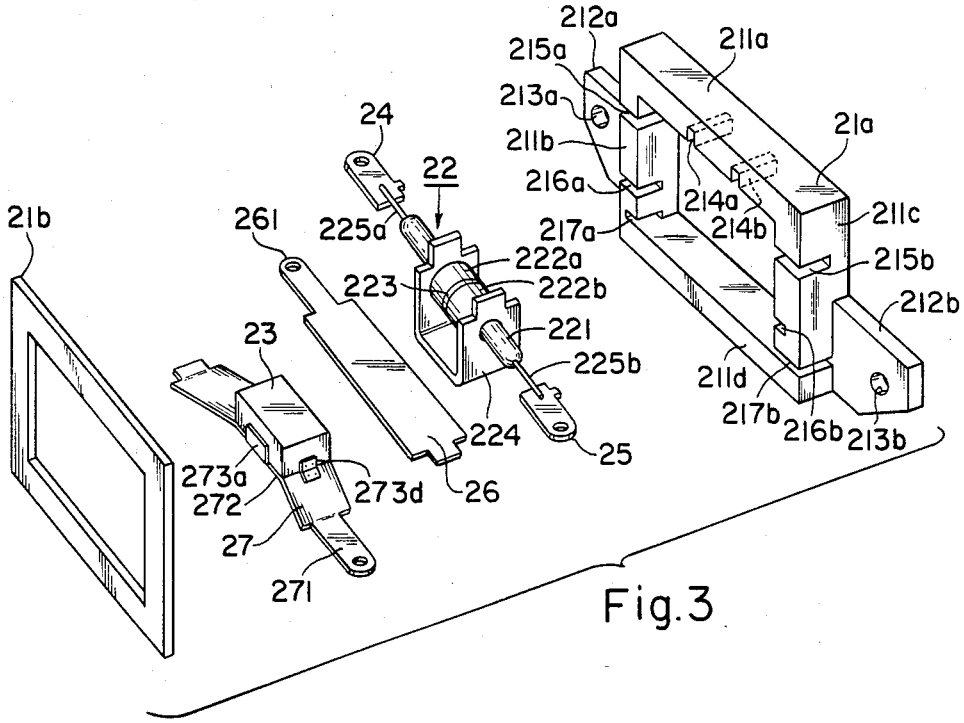
FIG. 3 is a perspective view of parts of the sensor of FIG. 2.

Referring to FIGS. 2 and 3, an air-flow-rate sensor 2 according to this invention comprises an insulator frame 21 having a main frame portion 21*a* and a supplemental frame portion 21*b* joined to one another, a thermo-magnetically operated switch 22, a positive temperature characteristic thermister 23 and terminal plates 24–27.

Figure 5:
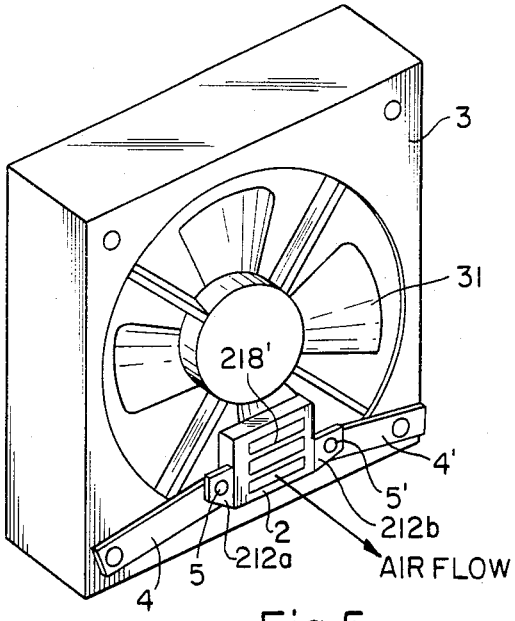
FIG. 5 is a perspective view of an air ventilation fan on which the sensor is mounted.

Main and supplemental frame portions 21*a* and 21*b* are made of paper-epoxy sheets laminated or other insulator plates, and are formed rectangular to have an rectangular opening. Main frame portion 21*a* is made generally rectangular by four side frame elements 211*a*–211*d*. Opposite two frame elements 211*b* and 211*c* are provided with tabs 212*a* and 212*b* projecting therefrom outwardly, respectively. Tabls 212*a* and 212*b* are formed with holes 213*a* and 213*b*, respectively, for receiving bolts by which the sensor 2 is fixedly mounted onto, for example, a ventilation fan as shown in FIG. 5.

In order to secure thermo-magnetically operated switch 22 to main frame portion 21*a*, frame element 211*a* is provided with two grooves 214*a* and 214*b* in its inner surface, and frame elements 211*b* and 211*c* are provided with grooves 215*a* and 215*b*, respectively, in their surfaces which are in contact with the supplemental frame portions 21*b*. Grooves 214*a* and 214*b* extend from a surface of the frame element 211*a* which is in contact with supplemental frame portion 21*b*, towards, but short of, the opposite surface. Grooves 215*a* and 215*b* extend from inner surfaces to outer surfaces of respective frame elements 211*b* and 211*c*. Two frames elements 211*b* and 211*c* are also provided with a pair of grooves 216*a* and 216*b* for securing terminal plate 26 and another pair of grooves 217*a* and 217*b* for supporting teminal plate 27. Grooves 216*b* and 217*a* are formed in the inner surfaces of frame elements 211*c* and 211*b*, respectively, to extend from their surfaces in contact with supplemental frame portion 21*b* towards, but short of, the opposite surfaces. While, grooves 216*a* and 217*b* are formed in the surfaces which are in contact with supplemental frame portion 21*b* to extend from the inner surfaces to the outer surfaces.

Thermo-magnetically operated switch 22 comprises a reed switch unit 221 wherein reed contact is hermetically sealed in a glass tube. Two cylindrical, or ring-like, permanent magnets 222*a* and 222*b* which are magnetized in an axial direction are mounted on reed switch 221 so that the magnetized direction of one magnet 222*a* is disposed similar to that of the other magnet 222*b* with a thin magnetic gap 223 therebetween. A "U"-shaped temperature sensitive ferromagnetic piece 224 is also mounted on reed switch 221. That is, two arm portions of the "U" are provided with holes in which reed switch 221 extends as shown in FIG. 3. The two arm portions of the "U" are in closely contact with opposite ends of the arranged two magnets 222*a* and 222*b*. Two terminal plates 24 and 25 are fixedly connected by, for example, soldering or welding, to leads 225*a* and 225*b* which outwardly project from opposite ends of reed switch 221. The thermo-magnetically operated switch 22 is mounted on main frame portion 21*a* by inserting the end portions of the arm portions of the "U"-shaped temperature sensitive ferromagnetic piece 224 into grooves 214*a* and 214*b*, respectively, as well as inserting terminal plates 24 and 25 into grooves 215*a* and 215*b*.

The thermo-magnetically operated switch 22 is substantially similar to one which in FIG. 3a of U.S. Pat. No. 3,750,064. The combination of permanent magnets 222*a* and 222*b* and magnetic gap 223 is substantially equivalent to an axially magnetized cylindrical permanent magnet having an axial length similar to the combination. The magnetic gap 223 plays a role for finely controlling an operating temperature of the thermo-magnetically operated switch. Therefore, the detailed description of operation will be omitted herein, but it is only described that reed switch 221 is switched off during a time period when the temperature of the ferromagnetic piece 224 is lower than its Curie point, but turns on when the temperature elevates to the Curie point.

Terminal plate 26 is a flat metal plate and has a finger portion 261 on its one end for connecting an external lead wire thereto. Terminal plate 26 is assembled into main frame portion 21*a* by inserting both ends of the plates into grooves 216*a* and 216*b*, respectively. Finger portion 261 is projected outside main frame portion 21*a* through groove 216*a*.

Another terminal plate 27 is made of a metal plate and is also provided with a finger portion 271 on its one end for connecting an external lead wire thereto. The terminal plate 27 is also mounted onto main frame portion 21*a* by fitting its both ends into grooves 217*a* and 217*b*, while the finger portion 271 being led out from the frame portion 21*a* through groove 217*b*.

In this embodiment, terminal plate 27 is bent in a form of an arch and its central portion 272 is disposed near the other terminal plate 26.

Positive temperature characteristic thermister 23 has electrodes on its opposite side surfaces. The thermister 23 is held by terminal plate 26 and central portion 272 of the other terminal plate 27, with the electrodes being in contact with terminal plates 26 and 27, respectively.

Terminal plate 27 elastically presses thermister 23 to terminal plate 26, which is, in turn, pressed to "U"-shaped ferromagnetic piece 224. Therefore, those parts 22–27 are mounted stationary without movement in main frame portion 21*a*.

Supplemental frame portion 21*b* is joined to main frame portion 21*a* by, for example, a binding agent after those parts 22–27 are assembled into main frame portion 21*a* as described above. As a result, since all grooves are closed, all parts 22–27 are firmly secured to frame 21.

Figure 4:
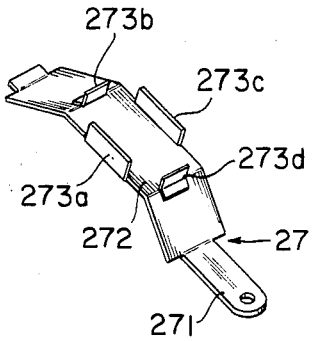
FIG. 4 is a perspective view of another embodiment of the second terminal plate.

In order to prevent thermister 23 from falling off or, moving on, terminal plate 27 is formed with four stoppers 273*a*–273*d* which stand up from four positions at periphery of central portion 272, as shown in FIG. 4. A pair of opposite stoppers 273*a* and 273*c* are formed by bending projections formed on opposite edges of terminal plate 27. Another pair of opposite stoppers 273*b* and 273*d* are formed by partially cutting portions of terminal plate 27 adjacent the central portion 272 and by bending the cut portions.

Opposite stoppers 273*b* and 273*d* can be formed as pieces separate from the terminal plate 27 which are welded onto terminal plate 27, as shown at 273*d* in FIG. 3.

When thermister 23 is put on central portion 272 of terminal plate 27, thermister 23 is prevented from moving on the central portion by engagement with stoppers 273*a*–273*d*.

Frame 21 is not necessarily required to comprise main portion 21*a* and supplemental portion 21*b* but can be formed with a single body. However, in case that frame 21 is made of the main and supplemental portions 21*a* and 21*b* as shown in FIG. 3, a process for assembling thermo-magnetically operated switch 22, terminal plates 26 and 27 together with thermister 23 into the frame 21 is carried out readily, because grooves for receiving them are open before joining supplemental frame portion 21*b* onto main frame portion 21*b*.

In use of the sensor 2, sensor 2 is fixedly disposed in an air flow by, for example, being mounted on a ventilation fan 3 as shown in FIG. 5. Support arms 4 and 4' are mounted on fan 3, and tabs 212*a* and 212*b* are fixed to ends of support arms 4 and 4', respectively, by bolt means 5 and 5'. Thus, sensor 2 is disposed adjacent fan blades 31.

In the condition, terminal plates 24 and 25 are connected to, for example, an alarm device (not shown). Finger portion 261 and 271 of respective terminal plates 26 and 27 are connected to electric power feed wires (not shown), so that thermister 23 is power supplied to generate heat.

In the embodiment shown in FIG. 2, since both leads of reed switch 221 oppositely project outside of the frame 21, and since finger portions 261 and 271 of terminal plates 26 and 27 oppositely project outside of the frame 21, they can be readily connected to the external lead wires.

During a period when fan 3 rotates at its rated speed, the heat generated by thermister 23 is taken away by the air flow caused by the fan, so that the ferromagnetic piece 224 is not sufficiently heated to its Curie point. Therefore, the reed switch 221 is maintained off so that the alarm device does not operate.

When fan 3 breaks down to reduce the air flow rate, the heat from thermister 23 is not so taken away so that the temperature of ferromagnetic piece 224 elevates to the Curie point. Then, reed switch 221 turns on so that the alarm device operates to notice ventilation failure.

During a period of the ventilation failure, the electric power is supplied to thermister 23 until the power switch is turned off. However, since the thermister 23 has a positive temperature characteristic, the calorific value of thermister 23 reduces by temperature elevation of the thermister. Therefore, temperature of thermister 23, ferromagnetic piece 224, frame 21 and others do not elevate above a certain temperature. Therefore, a danger is avoided that a fire is caused by energizing thermister 23 during ventilation failure. It is needless to say that the thermister 23 and the ferromagnetic piece 224 should be selected so that the temperature of the ferromagnetic piece 224 is maintained below its Curie point during valid ventilation but is elevated above the Curie point during ventilation failure.

In the arrangement of the sensor 2 as described above, since thermister 23 is pressed onto terminal plate 26 by arcuate terminal plate 27, the terminal plate 26 is pressed onto "U"-shaped ferromagnetic piece 224. Therefore, any gap where dust accumulates is not formed between terminal plate 26 and ferromagnetic piece 224, so that the responsibility of the sensor 2 to air-flow-rate variation is not degraded even in long use.

Figure 6:
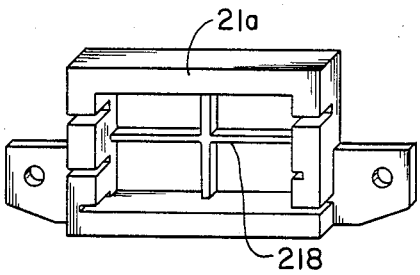
FIG. 6 is a perspective view of another embodiment of a main frame portion.
Figure 7:
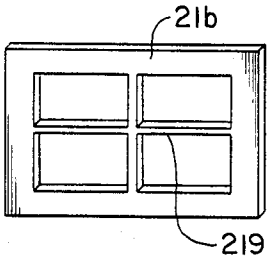
FIG. 7 is a perspective view of another embodiment of a supplemental frame portion.

Referring to FIGS. 6 and 7, main frame portion 21*a* and supplemental frame portion 21*b* can be provided with protective bars 218 and 219 of a cross type, respectively, to prevent operator's finger from carelessly touching those parts such as terminal plates 26 and 27, ferromagnetic piece 224 and so on, whereby operator is protected from receiving electric shock. Simple bars 218 can be used for the protecting bars as shown in FIG. 5. The protecting bars can be provided to not both of frame portions but one of them.

The sensor 2 as described above is simple in the construction and assembling. However, the glass tube of reed switch 221 is in a danger of destroy in assembling processes, because terminal plates 24 and 25 are previously fixed to leads 225*a* and 225*b* so that stress may be readily applied to glass portions sealing the leads. Therefore, terminal plates 24 and 25 can be fixed, and connected, to reeds 225*a* and 225*b* after assembling of the unit is completed. In that case, terminal plates 24 and 25 which are separate from leads 225*a* and 225*b* are inserted into respective grooves 215*a* and 215*b* (FIG. 3) together with leads 225*a* and 225*b* in assembling process. After being assembled into a condition as shown in FIG. 2, terminal plates 24 and 25 are welded to reeds 225*a* and 225*b*, respectively, as shown in FIG. 8.

Figure 8:
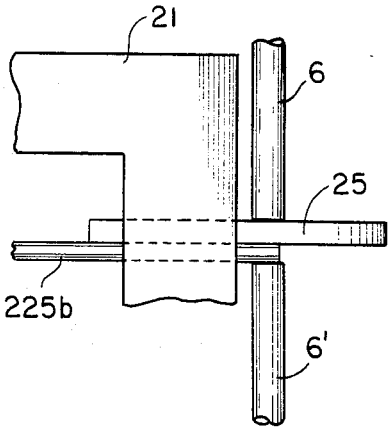
FIG. 8 is a front view for illustrating a process for spot welding a lead of reed switch to a terminal plate.

Referring to FIG. 8, lead 225*b* (225*a*) and terminal plate 25 (24) which project together from frame 21, are held by two electrodes 6 and 6' and come into close contact with one another. One electrode 6 is pressed onto terminal plate 25 (24), the other onto lead 225*b* (225*a*). Then, a high DC voltage is applied across both electrodes 6 and 6′, so that high DC current flows through a contact portion of the terminal plate and the lead to weld them. Thus, the lead and the terminal plate are mechanically and electrically connected.

The present invention has been described in detail in connection with preferred embodiments, but they are examples only. It will be easily understood that other various designations and modifications can be made by those skilled in the art within the scope of this invention.

What is claimed is:

1. An air-flow rate sensor for detecting whether the current air flow is less than a predetermined rate or not, which comprises:

an insulator frame having an opening chamber;

a thermo-magnetically operated switch comprising an assembly of a reed switch unit, at least one permanent magnet and at least one temperature sensitive ferromagnetic piece, said thermo-magnetically operated switch being mounted on said insulator frame to be fixedly disposed within said opening chamber;

first terminal plate means being in contact with said at least one temperature sensitive ferromagnetic piece of said thermo-magnetically switch and being fixedly mounted on said insulator frame to extend within said opening chamber;

second terminal plate means being spaced from said first terminal plate means and being fixedly mounted on said insulator frame to extend within said opening chamber; and positive temperature characteristic thermister means having two electrodes on its opposite side surfaces and fixedly held by said first and second terminal plate means, said two electrodes being in contact with said first and second terminal plate means, respectively.

2. The air-flow-rate sensor as claimed in claim 1, wherein said frame means has protecting bars extending in at least one opening end of said opening chamber.

3. The air-flow-rate sensor as claimed in claim 1, wherein said second terminal plate means is bent into a form of an arch so that a central portion thereof is disposed nearer to said first terminal plate means than the remaining portion thereof, and said positive temperature characteristic thermister means is pressed onto said first terminal plate means due to elasticity of said second terminal plate means bent.

4. The air-flow-rate sensor as claimed in claim 3, wherein said frame means is formed in a rectangular form to have four frame elements, two leads of said reed switch unit are supported in first and second grooves formed in opposite two first and second frame elements of said rectangular frame, respectively, said at least one temperature sensitive ferromagnetic piece being provided with a projection engaging with a third groove which is formed in an inner surface of a third frame element connecting between said first and second frame elements.

5. The air-flow-rate sensor as claimed in claim 4, wherein said thermo-magnetically operated switch comprises said reed switch unit, two ring-like permanent magnets being magnetized in an axial direction, said permanent magnets being mounted on, and axially disposed along, said reed switch unit with a small magnetic gap between said two permanent magnets, and a "U"-shaped temperature sensitive ferromagnetic piece mounted on said reed switch unit, two vertical arm portions of the "U" being in close contact with opposite ends of said two leads, respectively, and said first terminal plate means is in contact with a bottom portion of said "U"-shaped temperature sensitive ferromagnetic piece.

6. The air-flow-rate sensor as claimed in claim 5, wherein end portions of said two arm portions of said "U"-shaped temperature sensitive ferromagnetic piece are fitted into two grooves formed in the inner surface of said third frame portion.

7. The air-flow-rate sensor as claimed in claim 4, wherein third and fourth terminal plate means are fitted into said first and second grooves together with said two leads, respectively, said third and fourth terminal plate means being connected to said two leads, respectively, and projecting outwardly from said frame means.

8. The air-flow-rate sensor as claimed in claim 7, wherein said two leads of said reed switch unit are fixedly connected to said third and fourth terminal plate means by spot welding, respectively, at outside of said frame means.

9. The air-flow-rate sensor as claimed in claim 4, wherein opposite ends of said first terminal plate means are fitted into fourth and fifth grooves formed in said first and second frame elements, respectively.

10. The air-flow-rate sensor as claimed in claim 9, wherein one end of said first terminal plate means projects outwardly from said frame means for connecting with an external electric power feed line.

11. The air-flow-rate sensor as claimed in claim 9, wherein opposite ends of said second terminal plate means are fitted into sixth and seventh grooves formed in said first and second frame elements, respectively.

12. The air-flow-rate sensor as claimed in claim 11, wherein said second terminal plate means is bent into a form of an arch so that a central portion thereof disposed nearer to said first terminal plate means than the remaining portion thereof, and said positive temperature characteristic thermister means is pressed onto said first terminal plate means due to elasticity of said second terminal plate means bent.

13. The air-flow-rate sensor as claimed in claim 12, wherein said second terminal plate means is provided with several tab means which project from peripheries of said central portion of said second terminal plate means so as to engage with side surfaces of said positive temperature characteristic thermister means.

14. The air-flow-rate sensor as claimed in claim 11, wherein said frame means comprises a main rectangular frame portion and a supplemental rectangular frame portion, said main rectangular frame portion having said first to seventh grooves, and said supplemental rectangular frame portion being jointed to said main frame portion to close said grooves.

15. The air-flow-rate sensor as claimed in claim 14, wherein said supplemental rectangular frame portion has protecting bars extending in its opening.

16. The air-flow-rate sensor as claimed in claim 14, wherein said main rectangular frame portion has two support tab means protruding outwardly from opposite sides of said main frame portion, said support tab means being for fixedly mounting said sensor in an air-flow path.

17. The air-flow-rate sensor as claimed in claim 11, wherein one end of said second terminal plate means projects outwardly from said frame means for connecting with an external electric power feed line.

18. The air-flow-rate sensor as claimed in claim 17, wherein one end of said first terminal plate means projects outwardly from said frame means in a direction opposite to the projecting end of said second terminal plate means.

* * * * *